US009709072B2

(12) United States Patent
Cloarec et al.

(10) Patent No.: US 9,709,072 B2
(45) Date of Patent: Jul. 18, 2017

(54) ANGULAR DIFFUSER SECTOR FOR A TURBINE ENGINE COMPRESSOR, WITH A VIBRATION DAMPER WEDGE

(71) Applicant: SNECMA, Paris (FR)

(72) Inventors: Yvon Cloarec, Ecuelles (FR); Laurent Gilles Dezouche, Le Coudry Montceau (FR)

(73) Assignee: SNECMA, Paris (FR)

( * ) Notice: Subject to any disclaimer, the term of this patent is extended or adjusted under 35 U.S.C. 154(b) by 329 days.

(21) Appl. No.: 14/372,861

(22) PCT Filed: Jan. 11, 2013

(86) PCT No.: PCT/FR2013/050069
§ 371 (c)(1),
(2) Date: Jul. 17, 2014

(87) PCT Pub. No.: WO2013/107967
PCT Pub. Date: Jul. 25, 2013

(65) Prior Publication Data

US 2014/0341728 A1 Nov. 20, 2014

(30) Foreign Application Priority Data

Jan. 18, 2012 (FR) ..... 12 50487

(51) Int. Cl.
*F01D 9/04* (2006.01)
*F01D 25/24* (2006.01)
(Continued)

(52) U.S. Cl.
CPC ..... *F04D 29/44* (2013.01); *F01D 25/246* (2013.01); *F04D 29/444* (2013.01);
(Continued)

(58) Field of Classification Search
CPC ..... F04D 29/44; F04D 29/441; F04D 29/444; F04D 29/54; F04D 29/541; F04D 29/542;
(Continued)

(56) References Cited

U.S. PATENT DOCUMENTS 5,429,479 A 7/1995 Cordier
5,846,050 A 12/1998 Schilling
(Continued)

FOREIGN PATENT DOCUMENTS

EP 0 616 110 9/1994
EP 1 462 616 9/2004
(Continued)

OTHER PUBLICATIONS

Machine translation of FR 2636378, Mar. 16, 1990.*
International Search Report Issued May 17, 2013 in PCT/FR13/050069 Filed Jan. 11, 2013.

*Primary Examiner* — Christopher Verdier
(74) *Attorney, Agent, or Firm* — Oblon, McClelland, Maier & Neustadt, L.L.P.

(57) ABSTRACT

An angular diffuser sector for a turbine engine compressor is provided. The sector includes an inner shroud; an outer shroud; a vane; a casing element mounted at least in part around one of the shrouds and having an open groove facing an axial end of the corresponding shroud; a wedge-forming fitting interposed between the casing element and the corresponding shroud, the wedge presenting a first surface that contacts with a bearing surface of the axial end of the corresponding shroud, and a second surface that is inclined relative to the first surface and that contacts with a corresponding sloping surface of the groove in the casing element; and a device that exerts an axial force on the wedge so as to keep its first surface in contact with the bearing
(Continued)

surface and its second surface in contact with the sloping surface of the groove in the casing element.

12 Claims, 2 Drawing Sheets

(51) Int. Cl.
*F04D 29/54* (2006.01)
*F04D 29/44* (2006.01)
*F04D 29/64* (2006.01)
*F04D 29/66* (2006.01)
*F01D 11/00* (2006.01)

(52) U.S. Cl.
CPC ..... *F04D 29/542* (2013.01); *F04D 29/644* (2013.01); *F04D 29/668* (2013.01); *F01D 11/005* (2013.01)

(58) Field of Classification Search
CPC .... F04D 29/544; F04D 29/668; F01D 25/246; F01D 25/04; F01D 11/005; F01D 9/041; F01D 9/042; F01D 9/044; F05B 2260/694; F05B 2260/964; F05D 2260/96
USPC ..... 415/119, 208.2, 209.1, 209.2–209.4, 415/210.1, 211.2, 174.2, 191
See application file for complete search history.

(56) References Cited

U.S. PATENT DOCUMENTS

2010/0284805 A1* 11/2010 Uskert ..... F01D 5/323 415/209.3
2013/0078086 A1 3/2013 Breugnot et al.

FOREIGN PATENT DOCUMENTS

FR 2 636 378 3/1990
FR 2 960 591 12/2011

* cited by examiner

Fig. 1A
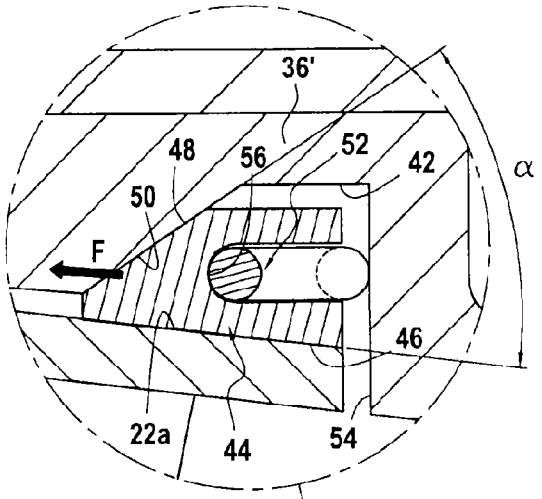
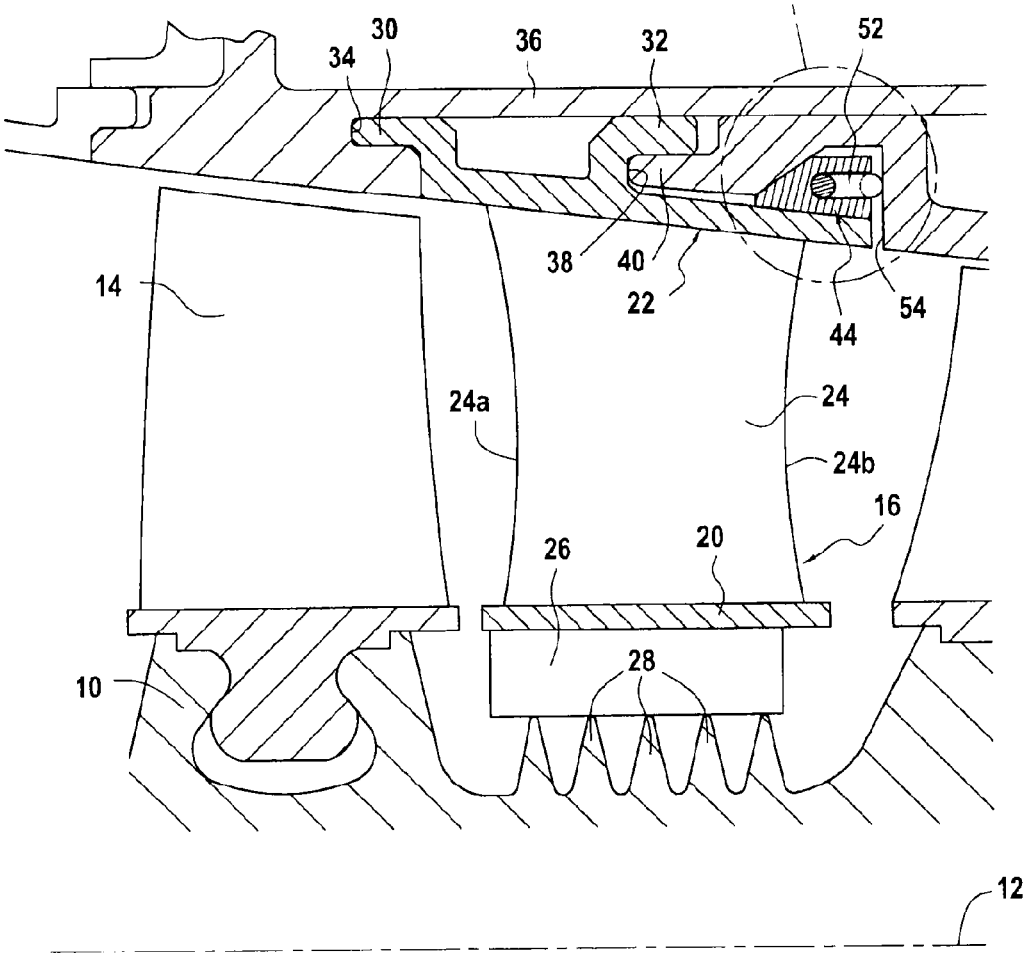
Fig. 1

FIG.2
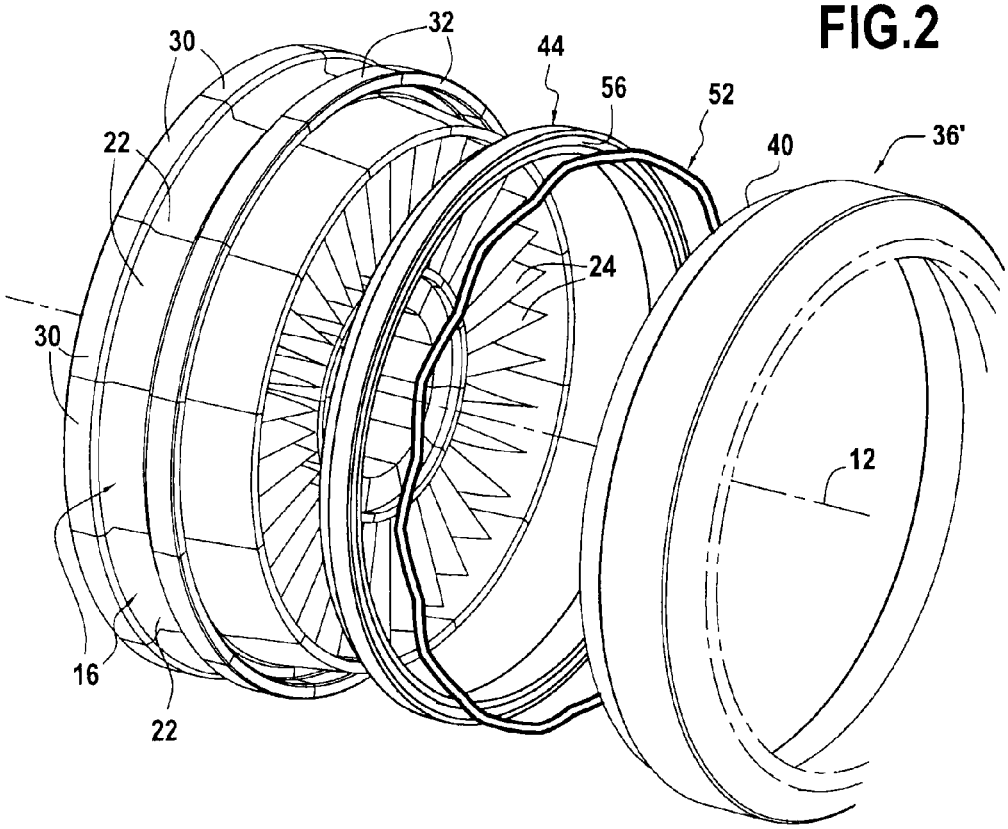
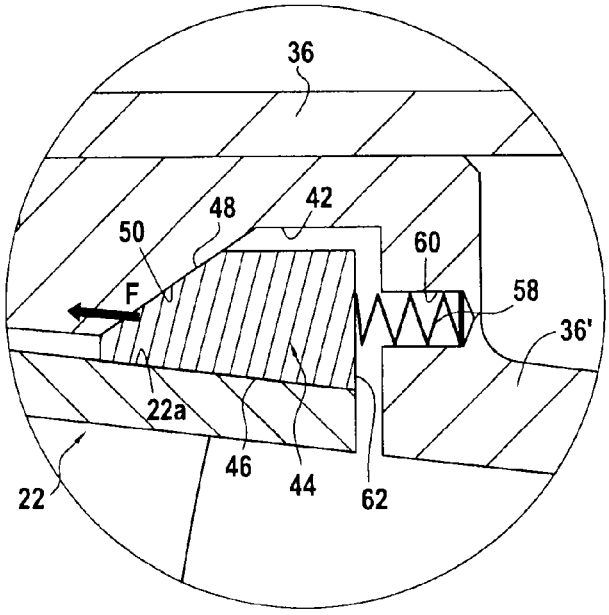
FIG.3

ANGULAR DIFFUSER SECTOR FOR A TURBINE ENGINE COMPRESSOR, WITH A VIBRATION DAMPER WEDGE

BACKGROUND OF THE INVENTION

The present invention relates to the general field of guide vanes for a compressor or a turbine of a turbine engine such as a turbojet, an airplane turboprop, a steam turbine, or a compressor.

More precisely, the invention relates to damping the vibration modes to which the vanes of a diffuser are subjected in operation.

In a turbine engine compressor, the compressor is made up of a plurality of compression stages, each made up of an annular row of blades mounted on a rotor shaft and a diffuser made up of a plurality of vanes mounted radially on an outer annular casing of the turbine engine.

A compressor diffuser is generally sectorized, i.e. it is made up of a plurality of angular sectors placed end to end around the longitudinal axis of the compressor. Typically, each diffuser sector comprises an inner shroud and an outer shroud that are arranged axially one inside the other, together with one or more vanes extending radially between the shrouds and connected thereto via their radial ends. At each of their radial ends, the outer shrouds of the diffuser sectors have means for mounting the sectors on the outer casing of the turbine engine.

In operation, an angular diffuser sector is subjected to high levels of mechanical stress, both static and in vibration. These mechanical stresses are withstood essentially by the leading-edge and trailing-edge zones of the vanes that are connected to the outer shroud of the diffuser sector. Since these connection zones are particularly thin, there is a risk that the resulting mechanical stresses damage or even destroy the leading and trailing edges of the vanes.

In order to avoid that drawback, various solutions have been envisaged. By way of example, mention may be made of patent applications FR 10/54849 and FR 10/54851 filed on Jun. 18, 2010, which make provision for housing a damper- or abutment-forming fitting in a cavity formed in the outer shroud of the angular diffuser sector so as to reduce the mechanical stresses to which the vane is subjected in operation. Also known is Document FR 2 896 548, which describes a set of diffusers in which one of the assembly tabs is connected to the outer shroud in a zone that is axially spaced away from the connection zone of the leading or trailing edges of the vanes with the outer shroud.

Although effective, those solutions present the disadvantage of leading to premature wear of the contact parts, which can lead to the assembly losing its damping ability.

OBJECT AND SUMMARY OF THE INVENTION

A main object of the present invention is thus to mitigate such drawbacks by proposing a solution for damping the vibratory modes to which the vane is subjected in operation, which solution continues to be effective even in the event of wear of the parts being used.

This object is achieved by an angular diffuser sector for a turbine engine compressor, the sector comprising an inner shroud, an outer shroud, at least one vane extending radially between the shrouds and connected thereto via its radial ends, a casing element mounted at least in part around one of the shrouds, said casing element having an open groove facing an axial end of the corresponding shroud, a wedge-forming fitting interposed radially between the casing element and the corresponding shroud, the wedge presenting a first surface for coming into contact with a bearing surface of the axial end of the corresponding shroud, and a second surface that is inclined relative to the first surface and that is to come into contact with a corresponding sloping surface of the groove in the casing element, and means for exerting an axial force on the wedge so as to keep its first surface in contact with the bearing surface and its bearing surface in contact with the sloping surface of the groove in the casing element.

The term "axial end" of the shroud is used herein to mean the leading edge or the trailing edge thereof.

The wedge of the diffuser sector of the invention is interposed between the casing element (a stationary portion) and one of the shrouds (a portion subjected to movement in a radial direction because of the mechanical stresses to which the diffuser sector is subjected in operation). The wedge is also subjected to an axial force urging it against the sloping surface of the groove in the casing. Because of the presence of this sloping surface, the wedge can be kept permanently in contact with the axial end (i.e. the trailing edge or the leading edge) of the shroud (via its first surface), and with the casing (via its second surface). These contacts lead to damping of the vibratory modes to which the vane is subjected in operation. Furthermore, the axial force exerted on the wedge serves to ensure that contact is made even in the event of the contact surfaces of the wedge being subjected to wear.

Preferably, the first and second surfaces of the wedge form an angle lying in the range 20° to 45°. Such an angle is large enough to prevent the wedge jamming between the casing element and the outer shroud, while remaining small enough to enable a limited axial force to produce the looked-for contacts.

The first and second surfaces of the wedge form an angle that may be open downstream.

The means for exerting the axial force on the wedge may comprise at least one spring bearing axially against the wedge. Under such circumstances, these means for exerting the axial force on the wedge may comprise an undulating annular spring bearing axially both against a radial face of the groove in the casing element and against a groove formed in the wedge fitting. Alternatively, these means for exerting the axial force on the wedge may comprise a plurality of helical springs, each received in a cavity in the casing element and bearing axially against a radial face of the wedge.

The invention also provides a turbine engine diffuser having a plurality of diffuser sectors as defined above. The invention also provides a turbine engine having at least one such diffuser.

BRIEF DESCRIPTION OF THE DRAWINGS

Other characteristics and advantages of the present invention appear from the following description made with reference to the accompanying drawings which show an embodiment having no limiting character. In the figures:

FIG. 1 is a fragmentary view in longitudinal section of a turbine engine compressor having angular diffuser sectors in accordance with the invention;

FIG. 1A is a zoomed-in view of a portion of the FIG. 1 diffuser;

FIG. 2 is an exploded perspective view of the FIG. 1 diffuser; and

FIG. 3 shows a variant embodiment of an angular diffuser sector of the invention.

DETAILED DESCRIPTION OF THE INVENTION

FIG. 1 is a highly diagrammatic and fragmentary view of a compressor stage of an aviation turbine engine, and FIG. 1A is a zoomed-in view of the circled portion of FIG. 1. This stage has a rotor shaft 10 centered on the longitudinal axis 12 of the compressor and carrying an annular row made up of a plurality of blades 14, and a diffuser 16 arranged downstream from the row of blades.

The diffuser described in this embodiment is sectorized as twelve angular sectors 16 that are placed end to end circumferentially around the longitudinal axis 12 of the compressor (see FIG. 2). Naturally, the invention also applies to a diffuser made up of parts occupying 360°.

Each angular diffuser sector 16 comprises an inner shroud 20 and an outer shroud 22 arranged coaxially one inside the other, together with one or more vanes 24.

When the diffuser sectors are placed end to end circumferentially, the shrouds 20 and 22 form rings defining radial limits of an annular flow passage for the gas passing through the diffuser.

In known manner, each vane 24 presents an airfoil defined by a pressure side face and a suction side face, which faces are connected together by a leading edge 24*a* and a trailing edge 24*b*. Each vane extends radially between the shrouds 20 and 22 and is connected thereto at its radial ends. The assembly comprising the vane 24 and the shrouds 20 and 22 may be formed as a single piece, e.g. obtained by casting.

The inner shroud 20 forms a portion of a ring. On its inside face it carries an abradable coating 26 for co-operating with radial wipers 28 carried by the rotor shaft 10 in order to avoid potential recirculation of gas under the inner shroud.

The outer shroud 22 is also in the form of a portion of a ring. On its outer face it carries an upstream attachment tab 30 and a downstream attachment tab 32 for mounting the diffuser sector on a diffuser casing.

To this end, the upstream attachment tab 30 projects axially upstream and is engaged in a corresponding slot 34 formed in a diffuser casing element 36 arranged around the outer shroud. The downstream attachment tab 32 projects axially downstream and co-operates with the outer surface 22*a* of the trailing edge of the outer shroud to define radially a slot 38 into which a tab 40 of another diffuser casing element 36' becomes engaged. It should be observed that this casing element 36' may be integral with the above-mentioned casing element 36. Furthermore, other ways of mounting the diffuser sector on the casing could be envisaged.

There follows a description of how vibratory modes of the vane are damped in operation in accordance with the invention. In the presently-described example, damping takes place at the trailing edge of the outer shroud. Nevertheless, this example is not limiting; damping could be performed at the leading edge and/or at the trailing edge of the outer shroud and/or of the inner shroud.

To this end, the casing element 36' on which the downstream attachment tab 32 is mounted is arranged at least in part around the outer shroud and presents an inwardly-open groove 42 facing the trailing edge of the outer shroud.

The diffuser sector also has a wedge-forming fitting 44 that is positioned in the groove 42 of the casing element 36' in such a manner as to be arranged radially between the casing element and the outer shroud.

The wedge is a fitting that is open (i.e. it is split), or it is preferably made up of a plurality of angular sectors that together make up a ring over 360°.

The wedge 44 presents a first surface 46 for coming into contact with the outer surface 22*a* of the trailing edge of the outer shroud (the outer surface 22*a* thus forms a bearing surface), and a second surface 48 that slopes relative to the first surface and that is to come into contact with a corresponding sloping surface 50 of the groove 42 in the casing element 36'. The first and second surfaces 46 and 48 of the wedge 44 thus form an angle $\alpha$ that may be open downstream (as shown in FIGS. 1 to 3) or else upstream.

Means are provided that exert an axial force on the wedge 44 so as to hold its first surface 46 in contact with the outer surface 22*a* of the trailing edge of the outer shroud 22 and its second surface 48 in contact with the sloping surface 50 of the groove 42 in the casing element 36'.

In the embodiment of FIGS. 1 and 2, such means comprise an undulating annular spring 52 bearing axially both against a radial face 54 of the groove 42 in the casing element and against a groove 56 formed in the wedge. More precisely, the groove 56 in the wedge 44 opens out axially downstream facing the radial face 54.

Thus, the undulating spring 52 exerts an axial force on the wedge 44 in the upstream direction (arrow F in FIG. 1A) so as to push it against the sloping surface 50 of the groove 42 in the casing element. Given the presence of the angle $\alpha$ that is open downstream between these surfaces 46 and 48 of the wedge 44, and in the presence of vibration leading to relative movements of the outer shroud of the diffuser sector, this force serves to ensure that contact is permanent firstly between the first face 46 of the wedge and the outer structure 22*a* of the trailing edge of the outer shroud 22, and secondly between the second surface 48 of the wedge and the sloping surface 50 of the groove 42 in the casing element 36'.

In the variant embodiment of FIG. 3, such means comprise a plurality of helical springs 58, each received in a respective cavity 60 in the casing element and bearing axially against a radial face 62 of the wedge 44. These helical springs may be spaced apart regularly around the longitudinal axis 12 of the compressor.

Thus, the helical springs 58 exert an axial force on the wedge 44 in the upstream direction (direction of arrow F in FIG. 1) so as to put it against the sloping surface 50 of the groove 42 in the casing element. This ensures that there is permanent contact firstly between the first surface 46 of the wedge and the outer surface 22*a* of the trailing edge of the outer shroud 22, and secondly between the second surface 48 of the wedge and the sloping surface 50 of the groove 42 in the casing element 36'.

Naturally, other means for exerting such an axial force on the wedge could be envisaged. For example, the axial force could be obtained by creating extra pressure in the enclosure inside the groove formed in the casing element.

In an advantageous arrangement, the angle $\alpha$ formed between the surfaces 46 and 48 of the wedge 44 lies in the range 20° to 45°. Such an angle is large enough to prevent the wedge jamming between the casing element and the outer shroud, while remaining small enough to allow a limited axial force to obtain the looked-for contacts.

The invention claimed is:

1. An angular diffuser sector for a turbine engine compressor, the sector comprising:

an inner shroud;

an outer shroud;

at least one vane extending radially between the shrouds and connected thereto via radial ends thereof;

a casing element mounted at least in part around one of the shrouds, said casing element having an open groove entirely formed in the casing element facing an axial end of the corresponding shroud;

a wedge-forming fitting interposed radially between the casing element and the corresponding shroud, the wedge presenting a first surface for coming into contact with a bearing surface of the axial end of the corresponding shroud, the bearing surface presenting a radial support, and a second surface that is inclined relative to the first surface and that is to come into axial contact with a corresponding sloping surface of the groove in the casing element; and elastic means for exerting an elastic axial force between the wedge and the casing element so as to keep the first surface in radial contact with the bearing surface and the second surface in axial contact with the sloping surface of the groove in the casing element.

2. A diffuser sector according to claim 1, wherein the first and second surfaces of the wedge form an angle therebetween lying in a range of 20° to 45°.

3. A diffuser sector according to claim 1, wherein the first surface and the second surface of the wedge form an angle that is open downstream.

4. A diffuser sector according to claim 1, wherein the elastic means for exerting the axial force on the wedge comprise at least one spring bearing axially against the wedge.

5. A diffuser sector according to claim 4, wherein the elastic means for exerting the axial force on the wedge comprise an undulating annular spring bearing axially both against a radial face of the groove in the casing element and against a groove formed in the wedge fitting.

6. A diffuser sector according to claim 4, wherein the elastic means for exerting the axial force on the wedge comprise a plurality of helical springs, each received in a cavity in the casing element and bearing axially against a radial face of the wedge.

7. A turbine engine diffuser comprising a plurality of diffuser sectors according to claim 1.

8. A turbine engine including at least one diffuser according to claim 7.

9. A diffuser sector according to claim 2, wherein the first surface and the second surface of the wedge form an angle that is open downstream.

10. A diffuser sector according to claim 2, wherein the elastic means for exerting the axial force on the wedge comprise at least one spring bearing axially against the wedge.

11. A diffuser sector according to claim 3, wherein the elastic means for exerting the axial force on the wedge comprise at least one spring bearing axially against the wedge.

12. A diffuser sector according to claim 1, wherein the wedge is disposed at a downstream end of the outer shroud, and the groove in the casing opens downstream.

* * * * *